US009127920B2

(12) United States Patent
Joseph et al.

(10) Patent No.: US 9,127,920 B2
(45) Date of Patent: Sep. 8, 2015

(54) PYROTECHNIC SLUG

(71) Applicants: Sharon Joseph, Tel El (IL); Yehiel Argaman, Moshav Aniam (IL); Tal Amlany, Kibutz Shamir (IL); Amit Harpaz, Rosh Pina (IL)

(72) Inventors: Sharon Joseph, Tel El (IL); Yehiel Argaman, Moshav Aniam (IL); Tal Amlany, Kibutz Shamir (IL); Amit Harpaz, Rosh Pina (IL)

( * ) Notice: Subject to any disclaimer, the term of this patent is extended or adjusted under 35 U.S.C. 154(b) by 0 days.

(21) Appl. No.: 14/386,008

(22) PCT Filed: Mar. 10, 2013

(86) PCT No.: PCT/IL2013/000028
§ 371 (c)(1),
(2) Date: Sep. 18, 2014

(87) PCT Pub. No.: WO2013/140387
PCT Pub. Date: Sep. 26, 2013

(65) Prior Publication Data

US 2015/0040745 A1 Feb. 12, 2015

(30) Foreign Application Priority Data

Mar. 20, 2012 (IL) ..... 218742

(51) Int. Cl.

| | |
|---|---|
| ***F42D 5/04*** | (2006.01) |
| ***F42B 12/20*** | (2006.01) |
| ***F42B 5/00*** | (2006.01) |
| ***F42B 5/28*** | (2006.01) |

(Continued)

(52) U.S. Cl.
CPC ... *F42D 5/04* (2013.01); *F42B 5/00* (2013.01); *F42B 5/28* (2013.01); *F42B 5/30* (2013.01); *F42B 10/40* (2013.01); *F42B 12/201* (2013.01); *F42B 15/10* (2013.01); *F42B 33/06* (2013.01); *F42C 1/08* (2013.01); *F42C 11/00* (2013.01); *F42C 15/00* (2013.01); *F42C 15/20* (2013.01)

(58) Field of Classification Search
CPC ..... F42B 10/40; F42B 12/201; F42B 15/10; F42B 33/06; F42B 5/00; F42B 5/28; F42B 5/30; F42C 1/08; F42C 11/00; F42C 15/00; F42C 15/20; F42D 5/04
USPC ..... 86/50; 102/346, 347, 356, 357, 371, 102/374, 376, 380, 439, 458, 202.1, 202.13, 102/204, 231, 234, 272, 274, 277.1
See application file for complete search history.

(56) References Cited

U.S. PATENT DOCUMENTS 3,570,405 A * 3/1971 Heady, Jr. ..... 102/202
3,599,569 A * 8/1971 Heartness ..... 102/371

(Continued)

*Primary Examiner* — Bret Hayes
(74) *Attorney, Agent, or Firm* — Haim M. Factor

(57) ABSTRACT

A pyrotechnic slug, intended to be used by bomb squads to neutralize explosive devices, comprising a hollow cylinder, having an internal space, and having a projectile body made of non-metallic material, the projectile body having a closed front end and an open back end receiving a slug plug, the internal space containing a mixture cavity holding a pyrotechnic mixture, which upon ignition and explosion thereof is configured to create a weak pressure wave, and the pyrotechnic slug having an operating system comprising at least one selected from a list including:

Figure 1:
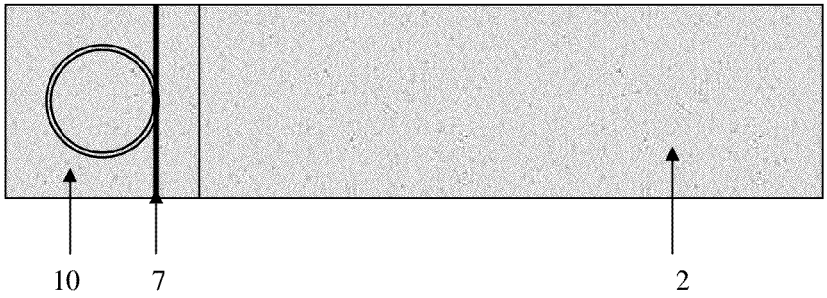

a) a mechanical impact firing system; and
b) a delayed operating system;

wherein the pyrotechnic slug is configured to be propelled from a barrel by one of:

a) a separate cartridge;
b) a unified slug comprising the projectile body inserted into a cartridge; and
c) a rocket motor.

4 Claims, 4 Drawing Sheets

(51) Int. Cl.

| | |
|---|---|
| ***F42B 5/30*** | (2006.01) |
| ***F42C 1/08*** | (2006.01) |
| ***F42C 11/00*** | (2006.01) |
| ***F42C 15/00*** | (2006.01) |
| ***F42B 10/40*** | (2006.01) |
| ***F42B 15/10*** | (2006.01) |
| ***F42B 33/06*** | (2006.01) |
| ***F42C 15/20*** | (2006.01) |

(56) References Cited

U.S. PATENT DOCUMENTS

| | | | | | |
|---|---|---|---|---|---|
| 3,838,532 | A | * | 10/1974 | Prodanovich | 42/1.14 |
| 3,913,482 | A | * | 10/1975 | Schiessl et al. | 102/346 |
| 3,981,241 | A | | 9/1976 | Ambrosini et al. | |
| 4,023,497 | A | * | 5/1977 | Morris et al. | 102/380 |
| 4,062,112 | A | * | 12/1977 | Lake | 30/228 |
| 4,080,901 | A | * | 3/1978 | Heier et al. | 102/380 |
| 4,169,403 | A | * | 10/1979 | Hanson | 86/50 |
| 4,307,665 | A | * | 12/1981 | Block et al. | 102/505 |
| 4,957,027 | A | | 9/1990 | Cherry | |
| 5,003,879 | A | * | 4/1991 | Jones | 102/204 |
| 5,182,417 | A | * | 1/1993 | Rontey et al. | 102/204 |
| 5,210,368 | A | * | 5/1993 | Heller et al. | 86/50 |
| 6,439,127 | B1 | | 8/2002 | Cherry | |
| 6,453,788 | B1 | * | 9/2002 | Lebet et al. | 86/50 |
| 6,516,725 | B2 | * | 2/2003 | Jackson et al. | 102/471 |
| 6,679,176 | B1 | | 1/2004 | Zavitsanos et al. | |
| 8,276,495 | B1 | * | 10/2012 | Chiu et al. | 86/50 |
| 2001/0054365 | A1 | * | 12/2001 | Strauss et al. | 102/272 |
| 2008/0011179 | A1 | * | 1/2008 | Michel et al. | 102/275 |
| 2009/0145320 | A1 | * | 6/2009 | Harrison | 102/204 |
| 2014/0238222 | A1 | * | 8/2014 | McKay et al. | 89/1.13 |

* cited by examiner

PYROTECHNIC SLUG

This US National Stage application claims priority PCT application no. PCT/IL2013/000028, filed 10 Mar. 2013 and from Israel Patent application no 218742, filed 20 Mar. 2012, whose disclosure is incorporated herein by reference.

TECHNICAL FIELD

The invention is directed towards police and military Bomb Squads for two primary reasons:

Treatment of terrorist explosive devices containing active explosives like: TNT, PETN, RDX, etc.

Opening and tearing of large, suspicious packages, such as: suitcases, backpacks, boxes, etc.

In addition, the invention can serve Special Forces (S.W.A.T Teams) for breaking & entering into high risk sites and neutralizing terrorists/criminals at hostage/kidnapping situations.

BACKGROUND OF THE INVENTION

Bomb squads across the world are assisted by a variety of means in the handling of suspicious objects with potential explosives.

The safest and most common manner used by these bomb squads is to attack the objects/explosives from a distance using various types of projectiles fired from a barrel (disruptors). Both means of attack and types of projectiles are greatly varied.

The most common disruptors are with 12.5 mm, 20 mm, 25 mm, 29 mm in diameter. The most common mean is the shotgun.

Shotguns are installed today onC-IED robots designated to neutralize explosives.

There is an additional configuration installed on a tripod.

The rounds are fired from the rifle and the tripod configuration, either mechanically or electrically.

Ammunition for disruptors is varied and includes the following configurations:

Metallic round, round containing sand, round containing zinc powder, water round, cement round, aluminum round, clay round.Etc.

The common denominator among these projectiles is that all of them, without exception, are inert and penetrate the suspicious object/explosive from the outside inwards. This method is effective for handling small objects/explosives, but has been found to be useless when coping with large objects/explosives, because the energy introduced into the object/explosive from the inert round is local and limited, and mostly wasted on localized breaking of the external packaging. In cases like these, there are two options:

1) Use of massive means of attack, whose peripheral damage exceeds their usefulness, in light of the quantity of explosive material required to produce a very massive round for cracking and penetrating the object sufficiently to take it apart. Utilization of this means constitutes a potential risk due to the large-range scattering of shrapnel and the scattering of shock waves in every direction, which might endanger life and property. Of course, this method is not applicable in urban/populated areas.
2) Manual handling of large explosives. This method constitutes great risk to the lives of the bomb technicians, in light of their necessary and immediate proximity to the object/explosive.

The invention presented here offers a solution to the problematics stemming from the above-stated methods. Firing of a pyrotechnical slug and its "cleaving" within the target it has penetrated, as a result of the initiation of pyrotechnic mixture within the slug, produces a weak pressure wave that is passed on to the contents of the object, propelling it while tearing/cleaving of the package and revealing its contents.

The advantages of the round are as follows:

The energy passed on to the object is under the required energy threshold for the initiation of standard explosive materials such as: C-4, PETN, SEMTEX, T.N.T, ANFO Etc.

The round splits into a number of smaller particles, which, due to their weights, are propelled for only short distances, mostly remaining in the target object. These pieces of shrapnel do not constitute any risk to human life, in light of the material from which they are constructed, their light weights and the short range of their paths, which is in the range of a few meters from the explosion point.

LIST OF DRAWINGS

FIG. 1—pyrotechnic slug—external view

Figure 2:
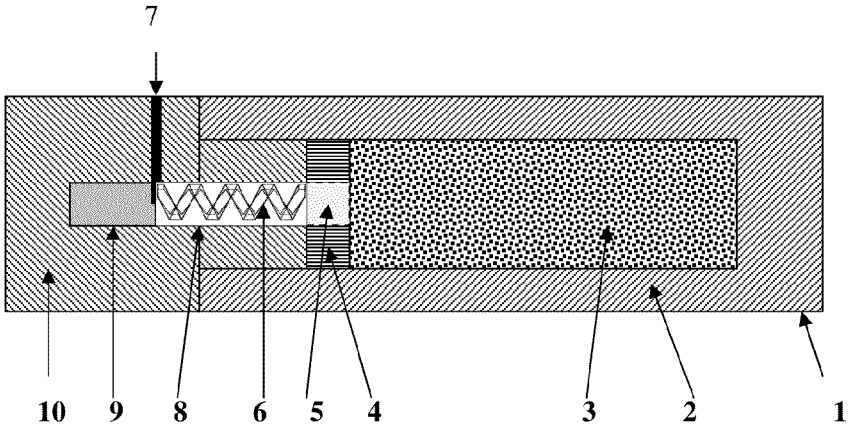

FIG. 2—pyrotechnic slug—cross-section

Figure 3:
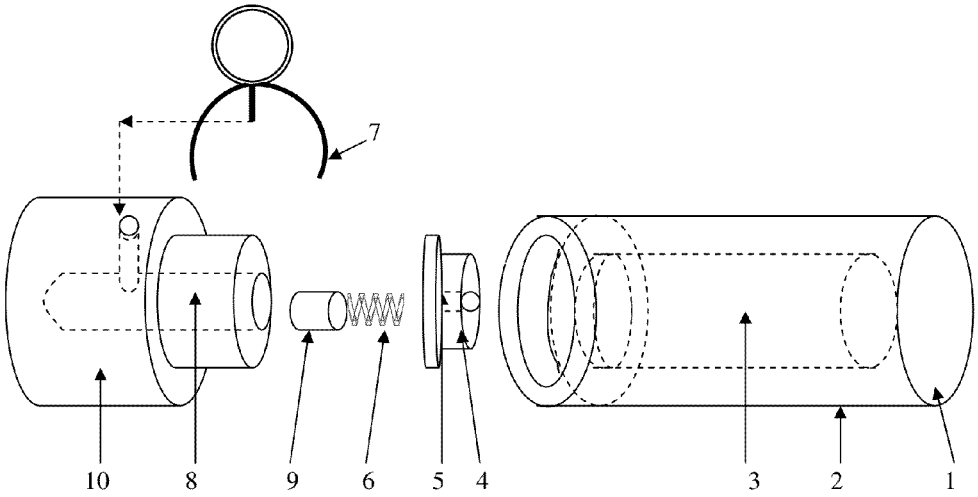

FIG. 3—pyrotechnic slug—component details

Figure 4:
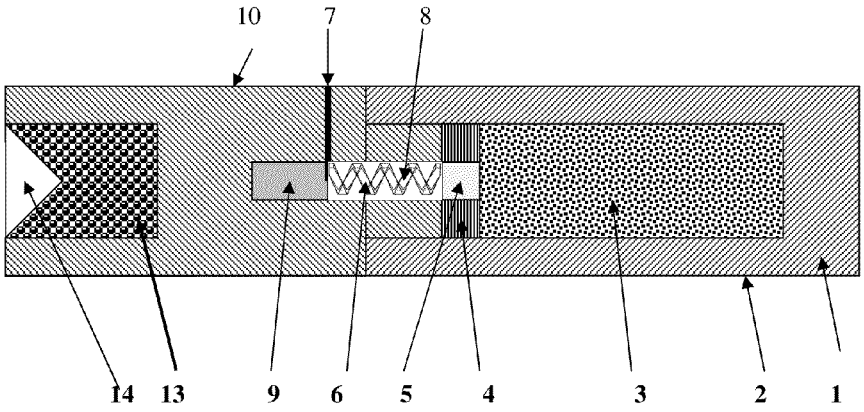

FIG. 4—cross-section of pyrotechnic round with rocket propulsion

Figure 5:
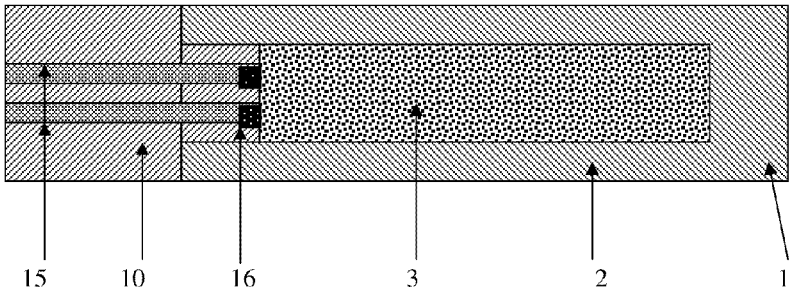

FIG. 5—cross-section of pyrotechnic round with pyrotechnic delay system

Figure 6:
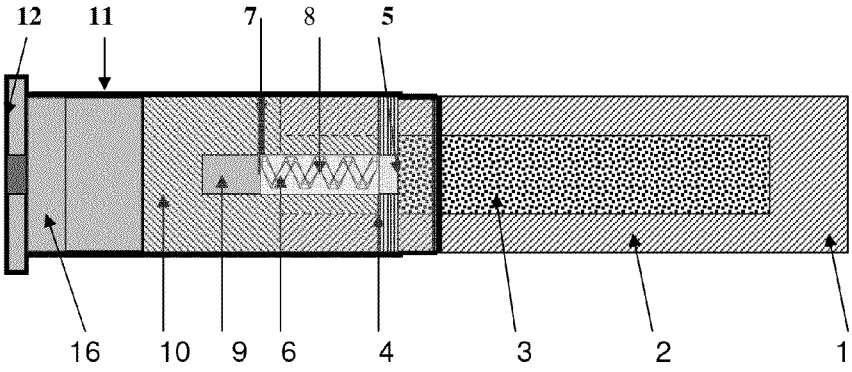

FIG. 6—cross-section of unified pyrotechnic round

Figure 7:
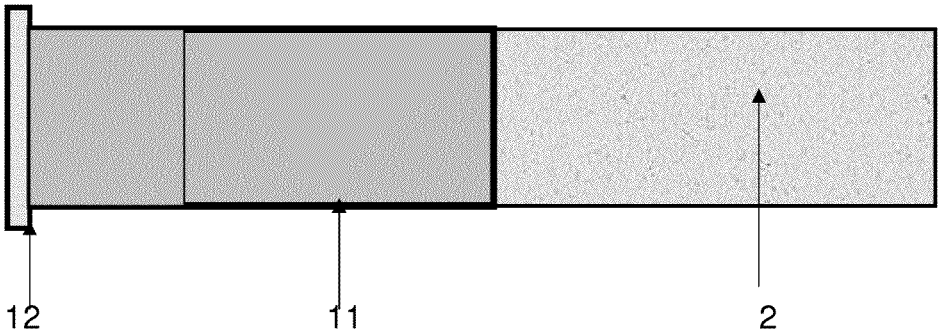

FIG. 7—unified pyrotechnic slug—external view

DETAILED DESCRIPTION OF THE INVENTION

The subject of this invention—the pyrotechnic slug—is composed of the following components:

A slug body (2) composed of a reinforced head (1) having a cavity (3) containing a pyrotechnic mixture (3A), a primer (5), firing pin system and a safety system.

Projectile Body (1):

The projectile body is constructed of non-metallic materials. The materials comprising the projectile body have three main objectives:

To prevent the closing of an electric circuit, which would cause the object/explosive to explode upon penetration: in the instance of a suspicious object, the bomb technician has no information regarding the contents of the object. The point of attack is a function of the type of object, its location and the bomb technician's experience. When attacking a verified explosive device, the bomb technician will operate according to the principle of minimal damage, i.e. minimizing the risk for explosion of the whole explosive mass. This is attained via direct attack into the explosive and it's dismantling into small lumps. In both of these situations, the projectile's penetration may cut and close the electric circuits of components of the explosive's operating mechanism, such as: electric wires, electrical parts, etc. The non-metallic projectile prevents this type of problem.

The projectile's explosion creates shrapnel. The non-metallic slug offered in this invention splits into a small number of parts which remain in the target. Even in the case of shrapnel exiting the target, it will not constitute a risk in light of its very short flight path, its light weight and the absence of sharp edges.

This method minimalizes the risk of the explosive device exploding from a direct hit of the initiated projectile.

The Pyrotechnic Mixture

This mixture, contained in the pyrotechnic mixture cavity (3), creates quiet high levels of explosion pressure which split the slug casing and cause the object contents to scatter; however, this energy is not sufficient to initiate standard explosives like TNT, PETN, RDX, Etc.

The quantity and composition of the mixture may be varied in accordance with the following objectives:

For optimal splitting, scattering and tearing of the object/explosive outer shell.

For optimal energy, still under the threshold of initiation of standard explosives materials.

For the prevention of significant shrapnel/shock waves that may cause injury/panic among populations.

The pyrotechnic mixture can be exchanged for various energetic materials in accordance with special needs.

The Slug Plug (10):

The slug plug connects to the back of the slug main body and is comprised of similar material that of the projectile body. The diameter of the plug is identical to that of the projectile body. Threading at the front connects to the threading at the back of the projectile body. The plug is designed to absorb firing pressure and contains a mechanism that activates the slug a firing pin system based on ballistic principles of recoil and forward momentum.

Slug Mechanism:

The mechanism is located inside the projectile plug and includes the following components:

Metal firing pin (9) set in a drilled space of the appropriate diameter. The size and weight of the firing pin determine the speed of its movement in the firing channel (8)—constituting the required delay and the force necessary to fire the primer.

The firing pin is designed to remain in the firing channel during the explosion and not to turn into shrapnel.

A metal spring (6) separator is located in the firing pin channel between the firing pin (9) and the primer (5), serving as a means of safety to prevent unintended operation of the projectile as a result of strong random movement or blows.

A metal manual safety band (7), constructed in a semi-circular shape, is wrapped around the pyrotechnic slug. In the curved inner area is a small metallic pin that penetrates into the projectile passing the firing channel, preventing the firing pin movement movement. In the upper outer curved region of the safety band, a metal ring serves to draw the safety band before firing.

Pyrotechnical Operating System (Drawing 5):

An additional version of the operating system is the pyrotechnic delay version. In this version, the slug's plug has two channels running along its length, which contain the pyrotechnic mixture that serves as a delay (15). At one end of the delay channel is the ignition pellet (16), intended to strengthen the flame passed on to the pyrotechnic mixture.

The pyrotechnic slug, equipped with the pyrotechnic delay mechanism, is operated in the following manner.

The cartridge that propels the slug ignites the pyrotechnic mixture that serves as a delay. At the end of the delay, while the slug is inside the target, the flame is passed on to the ignition pellet, which initiates the primary pyrotechnic mixture.

The advantages of this round lie in its ease of operation, its simplicity, its reliability and the absence of any mechanical mechanism.

Electronic Operating System: (FIG. 5)

Another version of the operating system is the electronic operation System—a tiny electronic operating system, equipped with a battery or piezoelectric source, is inserted into the slug's plug. This system is initiated by an electric ignuter inserted into the primary pyrotechnic mixture.

This system can also be present as the delay system version, primarily operated by a pyrotechnic delay system or a system with the characteristics of a mechanical firing system—a system that operates a slight delay only when the round hits the target.

Primer (5)

The primer is located in the cap housing (4), in a socket between the firing channel and the pyrotechnic mixture, and its diameter matches the inner diameter of the pyrotechnic round.

Operation of the Slug:

The slug is fired from inside a barrel via a mechanically- or electrically-operated cartridge. With the firing, the slug moves forward. This movement causes the firing pin to move back. When it hits the target, the slug suddenly slows down, as a result of contact between the front of the round and the outer casing of the suspicious object/explosive device. This slowing down causes the movement of the firing pin forward against the force of the spring this movement creates a short delay, enabling the slug to further penetrate the explosive device.

When the firing pin comes into contact with the primer, a spark is created, initiating the pyrotechnic mixture and causing an explosion.

Pyrotechnic Rocket Slug: (Drawing 4)

Another version of the pyrotechnic slug is a slug equipped with an independent movement system (rocket engine) (13) that is part of the enlarged slug plug.

The rocket engine is a small, energetic engine intended for a strong, swift propelling of the round out of the barrel and into the target. The advantage of this method is the ease of operation and absence of a need for carrying a heavy barrel, as required when using a round fired with a cartridge. With this method, one can use one or several disposable barrels that can be carried for long distances without limitations.

The rocket engine contains a mixture/chemical compound of energetic materials.

At the back of the rocket engine is a conical exhaust nozzle (14).

The rocket slug is operated with an electric igniter.

The round's structure and operation are identical to those of the standard pyrotechnic slug.

The Unified Slug (Drawing 7)

The unified slug is an additional version of the pyrotechnic slug. This slug is located inside a casing (11) that contains propellant material (17) at its bottom. The casing is constructed to absorb pressure created as a result of the burning of the propellant materials.

The propellant material is initiated by the primer or an electric igniter found at the base of the casing (12). The unified round is fired from a barrel such as that of a hunting rifle and is adapted for use with existing means of attack by bomb squads and explosive E.O.D units.

The internal structure of the slug (drawing 6) and its principles of operation are identical to those of the standard pyrotechnic slug.

The invention claimed is:

1. A pyrotechnic slug, intended to be used by bomb squads to neutralize explosive devices, the slug comprising:

a projectile body made of non-metallic material, wherein the body is cylindrical and defines a closed front end and an open back end;

a slug plug made of non-metallic material and received within the open back end of the body, the body and plug defining an internal mixture cavity;

wherein the mixture cavity contains only a pyrotechnic mixture;

wherein activation of the pyrotechnic slug comprises one of:

a) a mechanical impact firing system having a safety band and a separator spring; wherein the firing system further includes: a firing pin and a cap housing, the cap housing containing a primer mounted in close proximity to the pyrotechnic mixture; wherein the safety band is wrapped around the slug; and, b) a delayed operating system including at least one channel formed in the slug plug and an ignition pellet in the at least one channel adjacent the pyrotechnic mixture;

wherein the slug is configured to be propelled from a barrel by one of:

a) a separate cartridge;

b) a unified slug comprising the projectile body inserted into a cartridge; and, c) a rocket motor.

2. The pyrotechnic slug according to claim 1, wherein a propellant pyrotechnic mixture is contained in the separate cartridge and the propellant pyrotechnic mixture is configured to be fired by means of a firing pin or by means of an electric igniter.

3. The pyrotechnic slug according to claim 1, wherein the slug is configured to be propelled from a barrel by the rocket motor and wherein the rocket motor is formed of an elongated non-metallic tube containing propellant, the rocket motor further having a non-metallic exhaust nozzle in which an electric igniter is configured.

4. The pyrotechnic slug, according to claim 1, wherein the projectile body is inserted into the cartridge constructed of plastic and the cartridge contains a pyrotechnic propellant mixture configured to be ignited by means of a percussion cap or by means of an electric igniter.

* * * * *